US008033030B2

(12) United States Patent
MacFarlane

(10) Patent No.: US 8,033,030 B2
(45) Date of Patent: Oct. 11, 2011

(54) PILLOW SELECTION AND SLEEPER APPRAISAL

(76) Inventor: Andrew Robert MacFarlane, NSW (AU)

( * ) Notice: Subject to any disclaimer, the term of this patent is extended or adjusted under 35 U.S.C. 154(b) by 889 days.

(21) Appl. No.: 11/915,092

(22) PCT Filed: May 23, 2006

(86) PCT No.: PCT/AU2006/000676

§ 371 (c)(1),
(2), (4) Date: Nov. 20, 2007

(87) PCT Pub. No.: WO2006/125250

PCT Pub. Date: Nov. 30, 2006

(65) Prior Publication Data

US 2010/0192395 A1 Aug. 5, 2010

(30) Foreign Application Priority Data

May 23, 2005 (AU) ..... 2005902618

(51) Int. Cl.
*A41H 1/00* (2006.01)
*A61B 5/103* (2006.01)

(52) U.S. Cl. ..... 33/512

(58) Field of Classification Search ..... 33/512, 33/474, 476, 563, 565, 566
See application file for complete search history.

(56) References Cited

U.S. PATENT DOCUMENTS 745,171 A * 11/1903 Esbiornson ..... 33/474
1,046,365 A * 12/1912 Smith, III ..... 33/476
2,111,829 A * 3/1938 Winterer et al. ..... 33/272
2,835,220 A * 5/1958 Rardin ..... 33/370
3,106,127 A * 10/1963 Koller ..... 356/391
3,513,552 A * 5/1970 Lagrosse ..... 33/476
3,639,064 A * 2/1972 Haines ..... 356/613
4,444,204 A * 4/1984 Bryant et al. ..... 600/594
4,524,522 A 6/1985 Perry
4,756,090 A * 7/1988 Pedrow ..... 33/512
4,928,709 A * 5/1990 Allison et al. ..... 600/595
5,269,066 A * 12/1993 Walters ..... 33/451
5,419,054 A * 5/1995 Stoneberg ..... 33/474
5,457,832 A 10/1995 Tatum (Continued)

FOREIGN PATENT DOCUMENTS

BE 348189 1/1928

(Continued)

OTHER PUBLICATIONS

European Search Report, mailed on Sep. 24, 2009 in connection with corresponding International Application No. PCT/AU2006000676.

(Continued)

*Primary Examiner* — Christopher Fulton
(74) *Attorney, Agent, or Firm* — Design IP

(57) ABSTRACT

A neck measurement device and a method of selecting a pillow which takes into account the physique of the user are disclosed. A neck compression index (NCi) is calculated being the weight of the sleeper in kilograms divided by the shoulder width (ear to outer arm dimension) of the sleeper in centimeters. Preferably a compensated NCi is calculated which takes into account the softness or hardness of the mattress. A pillow resiliency is then selected based on the (compensated) NCi. Color coded pillow slips can be used to assist sleepers to self-select a pillow appropriate for their physique.

7 Claims, 3 Drawing Sheets

U.S. PATENT DOCUMENTS

| | | | | |
|---|---|---|---|---|
| 6,351,893 | B1 * | 3/2002 | St. Pierre | 33/563 |
| 6,499,223 | B2 * | 12/2002 | Momosaki | 33/562 |
| 7,647,707 | B2 * | 1/2010 | Manley et al. | 33/563 |
| 2003/0051362 | A1 * | 3/2003 | Buckman et al. | 33/566 |
| 2007/0157483 | A1 * | 7/2007 | DuMais | 33/512 |
| 2009/0205239 | A1 * | 8/2009 | Smith, III | 42/122 |

FOREIGN PATENT DOCUMENTS

| | | |
|---|---|---|
| DE | 1686893 | 11/1954 |
| DE | 9419311 | 2/1995 |
| EP | 0137612 | 4/1985 |
| EP | 1136868 | 9/2001 |
| JP | 10168631 | 6/1998 |
| JP | 2001299545 | 10/2001 |
| JP | 2001330434 | 11/2001 |
| JP | 2002336217 | 11/2002 |
| JP | 2004209099 | 7/2004 |

OTHER PUBLICATIONS

PCT International Search Report for Application No. PCT/AU2006/000676, dated Jun. 13, 2006.

PCT Written Opinion of the International Searching Authority for Application No. PCT/AU2006/000676, dated Jun. 13, 2006.

* cited by examiner

PILLOW SELECTION AND SLEEPER APPRAISAL

FIELD OF INVENTION

The present invention relates to pillows and, in particular, to the selection of the correct pillow characteristics to suit the physique of the user and the bed on which the user sleeps.

BACKGROUND

Many different types of pillows are manufactured and their properties vary considerably according to factors such as the shape of the pillow, the material from which the pillow is fabricated, the resiliency of that material, the age of the pillow, and so on. Similarly, there are many variations in mattresses, each of which results from a different manufacturing technique, different materials, different resiliency and so on.

Since persons come in many different shapes, sizes, and weights, inevitably there will be many mismatches between sleepers, pillows and mattresses. In particular, poor pillow support is thought to require the neck muscles to partially support the head during sleep. As these neck muscles tire, the sleeper tosses and turns in order to provide some respite for the neck muscles but thereby disturbs their sleep.

The genesis of the present invention is a desire to substantially overcome, or at least ameliorate, the abovementioned difficulties by the provision of a pillow selection process and apparatus which takes into account the physique of the user and type of bed and/or mattress (e.g. slats, spring mattress, foam mattress, latex mattress etc.).

SUMMARY

In accordance with a first aspect of the present invention there is disclosed a neck measuring device for pillow selection, said device comprising a generally planar body having at least one corner defined by two substantially straight edges which are substantially perpendicular to each other, one surface of said body having a scale extending along one of said edges and having regularly spaced marked indicia extending along said scale, wherein said indicia are mirror reversed whereby a user standing in front of a mirror and holding said device to his shoulder and neck, can read said indicia in said mirror.

In accordance with a second aspect of the present invention there is disclosed a method of selecting a pillow to suit the physique of a user, said method comprising the steps of:

(i) measuring the width of a shoulder of said user;

(ii) ascertaining the weight of said user;

(iii) from the results of steps (i) and (ii) calculating a neck compression index comprising the user's weight divided by their shoulder width; and (iv) for each calculated neck compression index selecting a corresponding pillow.

BRIEF DESCRIPTION OF THE DRAWING(S)

A preferred embodiment of the present invention will now be described with reference to the drawings in which.

DETAILED DESCRIPTION OF THE PREFERRED EMBODIMENT(S)

Figure 1:
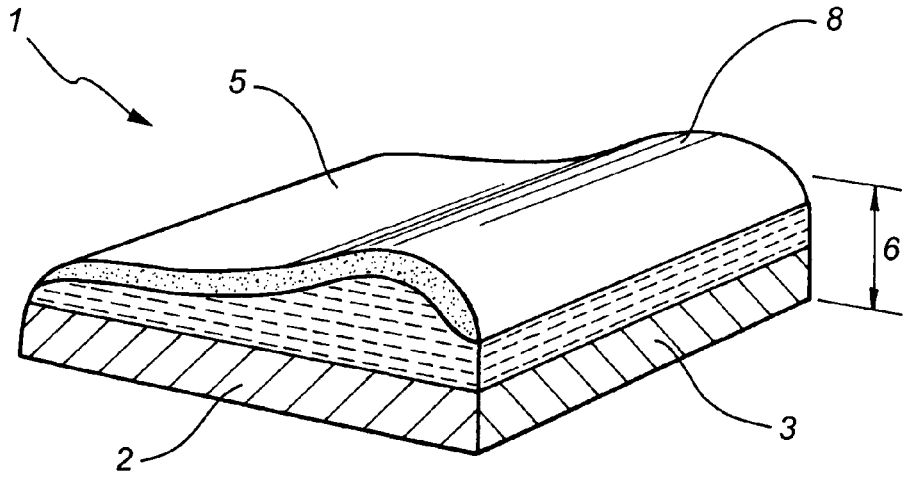
FIG. 1 is a schematic perspective view of a pillow in accordance with a preferred embodiment.

The pillow 1 of the preferred embodiment as illustrated in FIG. 1 has a longitudinal side 2 and a transverse side 3 (the other longitudinal side and the other transverse side not being apparent in FIG. 1). The upper surface 5 of the pillow 1 is shaped such that the longitudinal cross-section of the pillow is substantially constant. The transverse side 3 is preferably approximately 330 mm long and has an appreciable vertical extent 6 (unlike conventional pillows which have negligible vertical extent at their transverse side).

In addition, the upper surface 5 is formed with a crest 8 which is located closely adjacent the transverse side 3. Moving away from the crest 8 in a longitudinal direction towards the other transverse side the upper surface 5 falls away. The longitudinal side 2 is approximately 590 mm in length and substantially vertical. The longitudinal side 2 has substantially the same appearance as any longitudinal cross-section through the pillow 1. This is in marked contrast to conventional pillows where the longitudinal sides are substantially merely an edge.

Preferably the pillow 1 is formed from two, or even three, layers of foamed plastics or other elastomeric materials, such as polyurethane or latex, which preferably have different densities.

Figure 2:
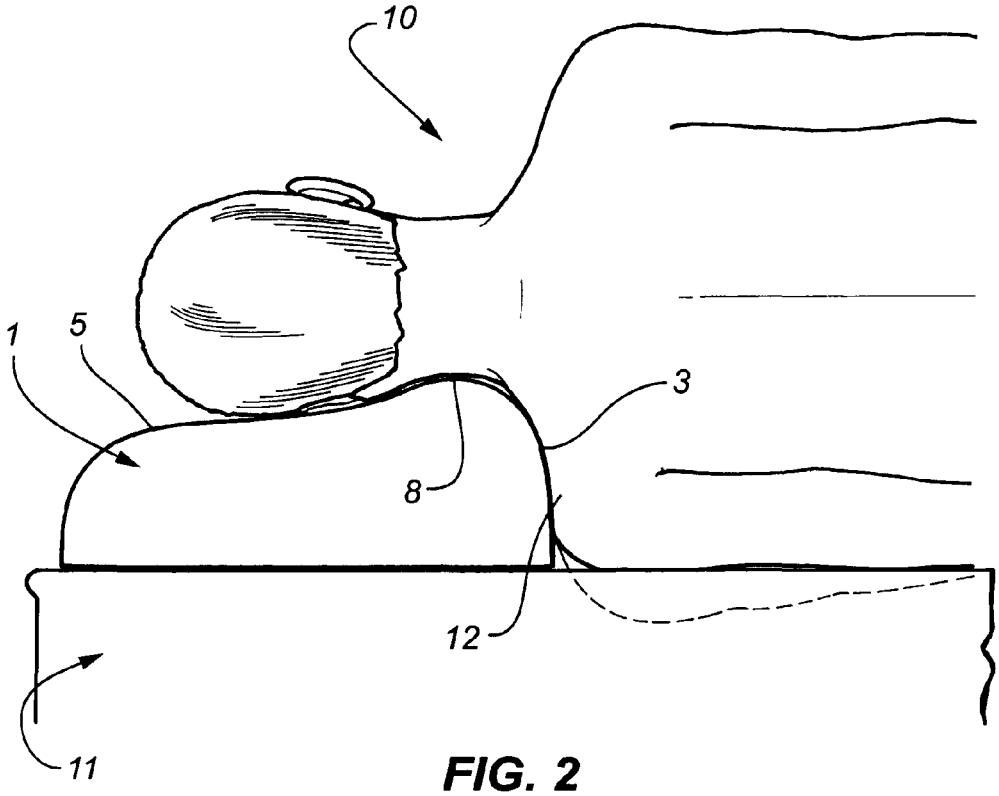
FIG. 2 is a schematic side elevation of a bed illustrating a sleeper sleeping on his side and utilizing the pillow of FIG. 1.

As seen in FIG. 2, a user 10 is depicted sleeping on a mattress 11 having a surface of negligible resilience or "give" and is also depicted sleeping on his side. It will be seen that the lower shoulder 12 of the user 10 either abuts, or is closely adjacent to, the transverse side 3. The crest 8 supports the neck of the user, in particular in the region between the ear and the shoulder. The upper portion of the head, in particular above the ear, is supported by the sloping surface of the pillow 1 which faces away from the shoulder 12.

An important advantage obtained by the pillow 1 is that the crest 8, in particular, supports the neck and lower head and thus the neck muscles are, in large part, relieved of this obligation. In addition, as indicated by broken lines in FIG. 2, the lower shoulder 12 in practice at least to some extent sinks into the mattress 11 or other supporting surface of the bed on which the user is sleeping. It is also desirable to gauge the resilience or firmness of the mattress so that this can be taken into account in assessing the effective vertical depth of the shoulder 12 in the sleeping position illustrated in FIG. 2.

Figure 3:
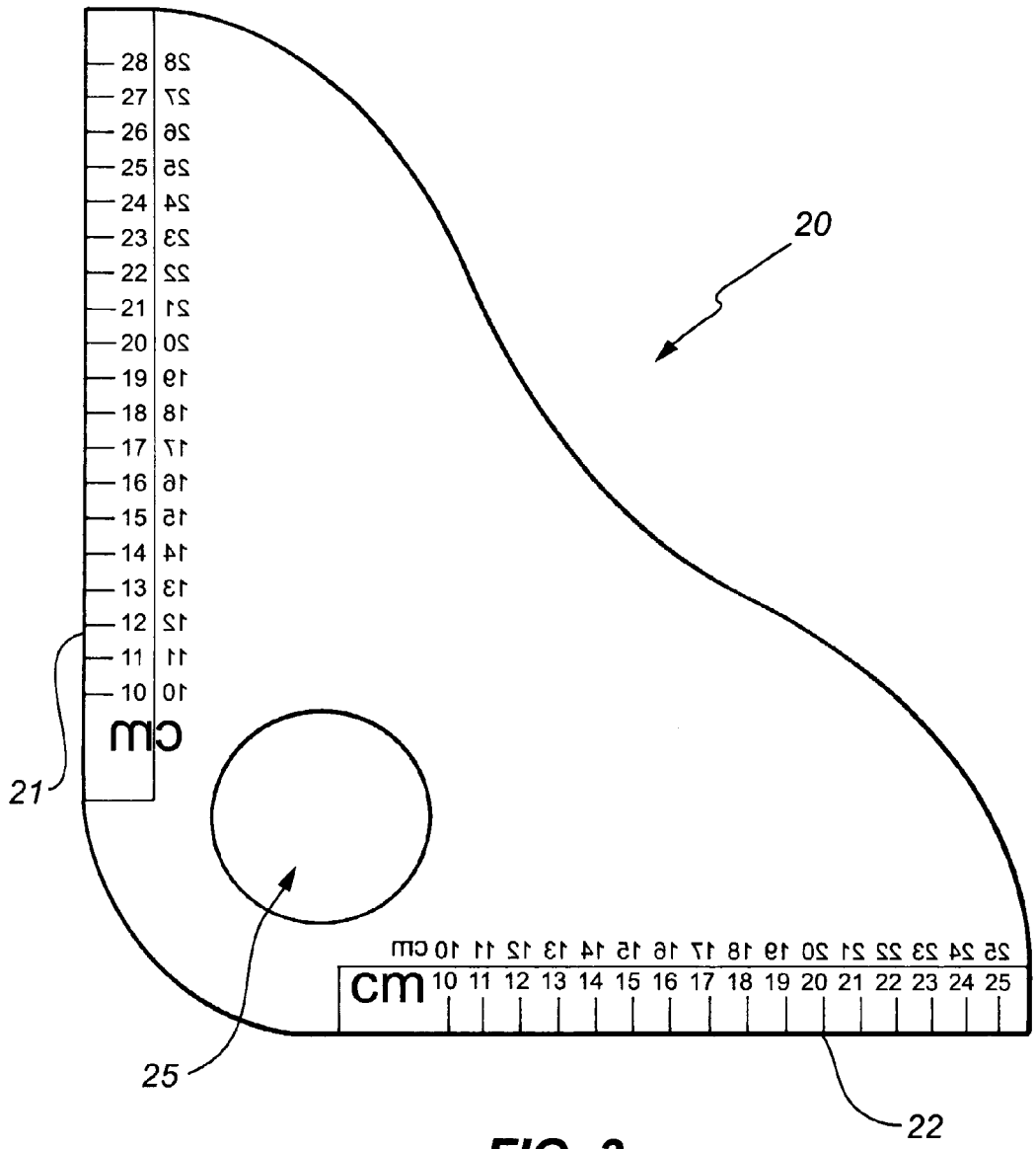
FIG. 3 is a plan view of a measuring device able to be utilized by a prospective purchaser.

In order to assist the user 2 to carry out the requisite measurements on himself, a generally L-shaped measuring device 20 as illustrated in FIG. 3 is provided. The device 20 has first and second edges 21, 22 which are substantially mutually perpendicular and each of which is provided with a ruled scale, preferably having two series of indicia. The first series of indicia is a conventional numerical scale and the second series of indicia is a mirror image reversal of the numbers of that scale. As a consequence of the mirror image reversal of the numbers of the scale, a user 10 can utilize the device 20 himself by standing in front of a mirror in order to measure the height of his head above the shoulder, and the horizontal extent from neck to shoulder. The shoulder width is the horizontal dimension from the user's ear to the outside edge of the adjacent arm. The head height is the vertical dimension from the upper surface of the shoulder to the top of the head. By looking in the mirror, the mirror reversed numerals are again reversed and thus are readily legible to the user 10.

Preferably the device 20 in addition to including instructions also includes an orifice 25 through which the user 10 may insert a thumb, for example, in order to assist the holding of the device 20 on the user's shoulder in order to take the requisite measurements. The device 20 is preferably fabricated from cardboard and has the scale, numbers and instructions printed thereon.

Figure 4:
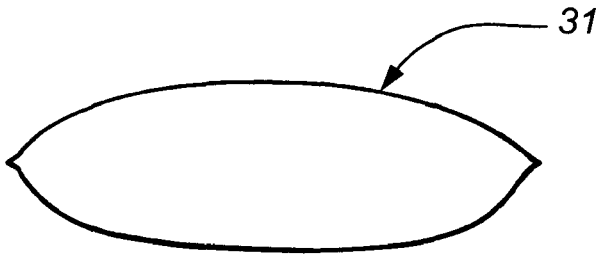
FIG. 4 PRIOR ART
FIG. 4 is a longitudinal cross-section (i.e. in the long dimension of the bed) through a conventional pillow.
Figure 5:
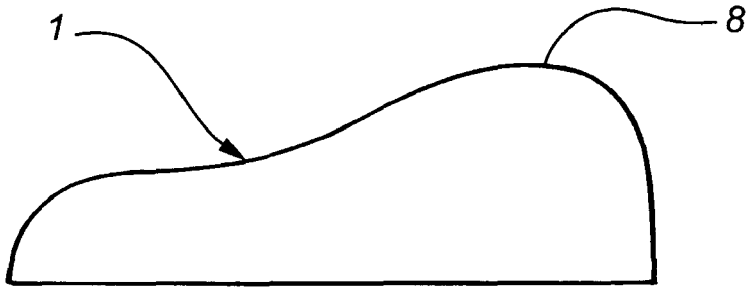
FIG. 5 is a longitudinal cross-section through the pillow of FIGS. 1 and 2.
Figure 6:
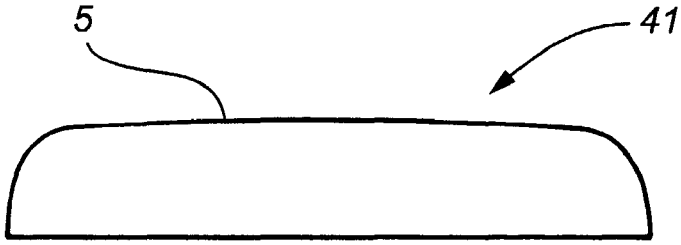
FIG. 6 is a longitudinal cross-section through a pillow most suitable for habitual back sleepers.
Figure 7:
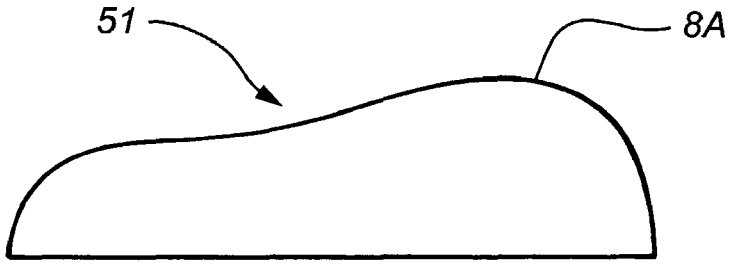
FIG. 7 is a longitudinal cross-section through a pillow most suitable for those sleepers who alternate between sleeping on their side and sleeping on their back.

Turning now to FIGS. 4-7, a number of different pillows are illustrated in longitudinal cross-section. FIG. 4 shows a conventional pillow 31 which has narrow transverse edges. FIG. 5 essentially repeats the shape of FIGS. 1 and 2 and illustrates the shape of the pillow 1 suitable for persons who habitually sleep on their side. FIG. 6 shows the shape of a pillow 41 suitable for a person who habitually sleeps on their back. It will be seen that the crest 8 is essentially reduced or abolished giving a generally level upper surface 5. For those persons who sleep alternatively on their back and on their side, a pillow 51 of the shape illustrated in FIG. 7 is best with a lesser crest 8 A than the crest 8 of FIG. 5.

The inventor has observed that head size, and hence head weight, differs little from one individual to another, but that body size including shoulder width, and hence the weight which compresses the mattress 11, varies to a very substantially degree from one individual to another. In response to this observation the inventor has developed a Neck Compression Index which is the total weight of a person in kg divided by the width (or sideways extent) of the person's shoulder in centimeters. Thus a first person weighing 110 kg and having a slight build with a shoulder width of only 18 cms has a neck Compression Index (NCi) of 110/18=6.1. Similarly another person who weighs 95 kg and has a normal build with a shoulder width of 18 cm has an NCi of 5.28. Conversely a 55 kg person with a shoulder width of 13 cms would have an NCi of 4.23. Typically the NCi is normally between about 3 and about 8.

The NCi provides an indication of the degree of pressure or force to which the pillow is subjected during sleep. The lower the NCi the less the density and/or hardness of the pillow which best matches the user's physique.

A very small percentage of the human population has either very long necks or very "tall" heads (or both) and thus need a pillow which is lengthened in the head to toe sleeping direction. The advantage of measuring the head height by the device 20 of FIG. 3 is that it enables this small percentage of the population to be accorded the different treatment they require.

The nature of the mattress is also preferably taken into account. For example, a very soft mattress compresses under the weight of the sleeper to an appreciable extent below the undeformed upper level of the mattress, for example by as much as 15 cm. Therefore before the neck compression index is calculated the shoulder width should be adjusted to account for the nature of the mattress. Furthermore, a pillow top (an additional layer of padding) can reduce the shoulder width by from 2-5 cms. These adjustments are summarized in the following table.

TABLE 1

| Mattress Type | Adjustment to measured shoulder width |
|---|---|
| Hard | Subtract 2 cm |
| Medium | Subtract 2-5 cm |
| Soft | Subtract 5-8 cm |
| Pillow Top | Subtract 2-5 cm |

That is, using the adjusted shoulder width an NCi can be calculated which is compensated for the nature of the mattress (and also any pillow top).

Turning now to the pillow, different manufacturing techniques have different ways of measuring the resilience of the pillow. For latex pillows there is a standard referred to as "indent deflection loading" or IDL which utilizes the pressure or weight required to compress by 40% a block of foam typically one foot by one foot in area to be compressed and eight inches thick. Very soft latex or foam pillows which compress to a substantial degree have an IDL of typically 6-8 whereas "hard" latex or foam pillows which only compress a small amount have an IDL of typically 10-15.

Pillows made from polyurethane foam, or latex, use a different measuring criteria, namely the mass or density of the foam material expressed in kilograms per cubic meter. "Soft" pillows are typically 50-65 kg/m3 whilst "hard" pillows are typically 70-75 kg/m3.

In addition, pillows made from polyurethane or latex foam use a still further standard rating which utilizes two letters and a pair of two digit numbers. "Soft" foam pillows have a rating such as VF52-40, or OP35-110 or HF18-35 whereas "hard" foam pillows have a rating such as AA15-60, or AA17-80 or LR38-40. These figures need to be modified somewhat if the pillow is provided with an array of vertical holes (e.g., 5 mm in diameter) and/or horizontal channels, both of which reduce the effective hardness.

With the above in mind it is possible to draw up a selection table which enables a pillow to be selected once the neck compression index, and preferably the compensated neck compression index, has been calculated. Table II is such a selection table.

TABLE II

| Compensated NCi Range | Latex Pillow IDL Range | Latex Pillow Kg/m$^3$ Range | Foam Pillow Hardness & Density Grade |
|---|---|---|---|
| 3-4 | 8-9 | 50-60 | HS18-35 |
| 4-5 | 9-10 | 65 | VF52-40 |
| 5-6 | 10-12 | 70 | ST29-60; LR38-40 |
| 6-8 | 12-15 | 75 | MA25-60; AA17-80; AA15-60 |

A preferred embodiment of the present invention is particularly applicable to accommodation establishments such as hotels, motels, and the like. Such establishments pride themselves on offering their customers a good night's sleep which naturally requires that the customer, mattress and pillow be matched to the maximum possible extent. This can be achieved in accordance with the preferred embodiment as follows.

The accommodation establishment normally has a single type (or a restricted number of types) of mattress throughout all its bedrooms. Thus the establishment can select, say, four different types of pillows which cover the expected range of uncompensated neck compression indices for substantially all their customers. These pillows are then placed in corresponding color coded pillow slips and all four types of pillows are provided for each bed in each room. In addition, each room is provided with the device of FIG. 3 and instructions (labeled Personal Pillow Selection) to the room occupant to use the device of FIG. 3 to measure his NCi. Once this has been calculated it falls within one of the ranges of pillows and so the correspondingly colored pillow slip is determined and the correct pillow thereby selected. The uncompensated NCi can be used because the nature of the mattress is known beforehand.

In another embodiment, a mail order pillow purchasing business can be conducted in which the customers using a personal measuring kit determine their weight and their neck and head dimensions and supply these together with their details of their mattress to the vendor. The vendor then calculates the compensated NCi and determines a suitable pillow which is then either fabricated or selected from the range of pillows on offer by different pillow manufacturers.

The foregoing describes only some embodiments of the present invention and modifications, obvious to those skilled in the art, can be made thereto without departing from the scope of the present invention.

In this specification, inferences to the masculine gender are to be taken to include the feminine gender, and vice versa.

The term "comprising" (and its grammatical variations) as used herein is used in the inclusive sense of "having" or "including" and not in the exclusive sense of "consisting only of."

What is claimed is:

1. A neck measuring device for pillow selection, said device comprising a generally planar body having at least one corner defined by two substantially straight edges which are substantially perpendicular to each other, one surface of said body having a scale extending along one of said edges and having regularly spaced marked indicia extending along said scale, wherein said indicia are mirror reversed whereby a user standing in front of a mirror and holding said device to his shoulder and neck, can read said indicia in said mirror.

2. The device as claimed in claim 1 wherein each of said edges has a scale and said mirror reversed indicia.

3. The device as claimed in claim 1 wherein said planar body is generally L-shaped.

4. The device as claimed in claim 1 and having an orifice therein dimensioned to receive at least one of the fingers of said user.

5. The device as claimed in claim 1 being fabricated from cardboard and having said scale and indicia printed thereon.

6. The device as claimed in claim 1 wherein said corner is round.

7. A neck measuring device for pillow selection, said device comprising:

a generally planar body having at least one corner defined by two substantially straight edges which are substantially perpendicular to each other, one surface of said generally planar body having a scale extending along one of said substantially straight edges and having a first series of regularly spaced marked indicia extending along said scale and a second series of regularly spaced marked indicia extending along said scale, wherein the first series is a conventional numerical scale and the second series is a mirror image reversal of the conventional numerical scale which appear as conventional numerals when viewed in a mirror.

* * * * *